US008672467B2

(12) United States Patent
Yamanobe

(10) Patent No.: US 8,672,467 B2
(45) Date of Patent: Mar. 18, 2014

(54) INKJET RECORDING APPARATUS

(75) Inventor: Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 133 days.

(21) Appl. No.: 13/329,338

(22) Filed: Dec. 19, 2011

(65) Prior Publication Data

US 2012/0176435 A1 Jul. 12, 2012

(30) Foreign Application Priority Data

Jan. 6, 2011 (JP) ..... 2011-001434

(51) Int. Cl.
*B41J 2/01* (2006.01)
*B41J 29/38* (2006.01)

(52) U.S. Cl.
USPC ..... 347/102; 347/103; 347/16

(58) Field of Classification Search
USPC ..... 347/16, 102, 103
See application file for complete search history.

(56) References Cited

U.S. PATENT DOCUMENTS

| | | | | |
|---|---|---|---|---|
| 2001/0052920 | A1 | 12/2001 | Matsumoto et al. | |
| 2004/0189769 | A1* | 9/2004 | Wilbur et al. | 347/102 |
| 2007/0153074 | A1* | 7/2007 | Anderson et al. | 347/102 |
| 2009/0244232 | A1* | 10/2009 | Haba | 347/102 |
| 2010/0007901 | A1* | 1/2010 | Horii et al. | 358/1.9 |

FOREIGN PATENT DOCUMENTS

| | | | |
|---|---|---|---|
| JP | 2002-011860 | | 1/2002 |
| JP | 2002011860 | A * | 1/2002 |
| JP | 2004-050451 | | 2/2004 |
| JP | 2006-056126 | | 3/2006 |
| JP | 2010-125834 | A | 6/2010 |

OTHER PUBLICATIONS

Partial English language translation of the following: Office action dated Feb. 12, 2013 from the Japanese Patent Office in a Japanese patent application corresponding to the instant patent application.

Partial English language translation of the following: Office action dated Nov. 13, 2012 from the Japanese Patent Office in a Japanese patent application corresponding to the instant patent application. This office action translation is submitted now in order to supplement the understanding of patent document JP 2006-056126, JP2002-011860 and JP2004-050451 which are cited in the office action and are being disclosed in the instant Information Disclosure Statement.

* cited by examiner

*Primary Examiner* — Sarah Al Hashimi
(74) *Attorney, Agent, or Firm* — SOLARIS Intellectual Property Group, PLLC

(57) ABSTRACT

An inkjet recording apparatus includes: a conveyance unit conveying a recording medium; inkjet recording heads jetting ink droplets onto a recording medium surface while scanning in a recording direction intersecting a conveyance direction; a first image converter converting image data, which have been inputted, into ink data based on the color of ink; a second image converter converting the ink data into dot data on the basis of which each inkjet recording head jets the ink droplets; a drying unit disposed on a conveyance direction downstream side of the inkjet recording heads and drying the ink droplets while moving in a drying direction differing from the conveyance direction; and a drying unit movement controller deciding and controlling a moving speed of the drying unit on the basis of at least one of the inputted image data, the ink data, or the dot data.

10 Claims, 8 Drawing Sheets

FIG.7

| | N=4 | | | | N=2 | | N=1 |
|---|---|---|---|---|---|---|---|
| | n=0 | n=1 | n=2 | n=3 | n=0 | n=1 | |
| D(6) | | | | | | | |
| D(5) | | | | | | | |
| D(4) | | | | | | | |
| D(3) | | | | | | | |
| D(2) | | | | | | | |
| D(1) | | | | | | | |
| D(0) | | | | | | | |

INKJET RECORDING APPARATUS

CROSS-REFERENCE TO RELATED APPLICATION

This application claims priority under 35 USC 119 from Japanese Patent Application No. 2011-001434 filed Jan. 6, 2011, the disclosure of which is incorporated by reference herein.

BACKGROUND OF THE INVENTION

1. Field of the Invention

The present invention relates to an inkjet recording apparatus.

2. Related Art

Conventionally, inkjet recording apparatus that record images, characters, and so forth by jetting a liquid such as ink onto a liquid-absorbing recording medium surface have had the problem that they end up causing damage to the printed materials on which they have finished processing because of a phenomenon called blocking where a liquid such as the ink that forms the image, a solvent, or a dispersion medium seeps into the recording medium and the inks on the printed materials that have been accumulated stick (fix) to each other because of insufficient drying and insufficient fixing of the image portions. Particularly in high-productivity inkjet presses, there is a tendency for the drying and fixing time to become shorter, so it becomes easier for insufficient drying and insufficient fixing to arise and it also becomes easier for blocking to occur in cases where printing has been performed on thick paper.

However, performing long drying across the board on the entire recording medium in a drying unit is not desirable because it lowers the processing capacity of the apparatus because it increases the processing time of the entire process. Further, preparing a dryer of a size that covers the entire width of the recording medium is inefficient in a case where there are plural types and sizes of recording media, and in the paper width neighborhoods there is the concern that paper uplift will occur because the drying air goes around to the reverse side of the medium.

For this reason, as shown in FIG. 8, there has been disclosed an image recording apparatus that is equipped with a drying unit 242 movable in a conveyance width direction on a conveyance direction downstream side of an inkjet recording head and blows drying air on both sides in the conveyance width direction (e.g., see Japanese Patent Publication Laid-Open No. 2010-125834).

Here, the moisture content (quantity of absorbed liquid) of the recording medium differs between the image portion of the recording medium—that is, the portion onto which the ink has been jetted and which has absorbed the ink—and the non-image portion—that is, the white background portion that has not absorbed the ink. Thus, there is the problem that if the recording medium is strongly dried across the board, this causes non-uniform contraction of the recording medium and produces deformation (cockling) in the recording medium after processing, but the configuration described in Japanese Patent Publication Laid-Open No. 2010-125834 has the problem that it cannot deal with this difference in moisture content between the white background portion and the image portion.

That is, when the drying unit 242 of the configuration described in Japanese Patent Publication Laid-Open No. 2010-125834 (FIG. 8) blows drying air (drying energy) across the board onto the paper, there is the concern that the white background portion whose moisture content is low will be over-dried and that the paper will cockle. What is needed is drying control based on changes in print modes in which the output image to be recorded on the recording medium and the conveyance speed (single paper feed amount) change.

SUMMARY OF THE INVENTION

In consideration of the above-described circumstances, the present invention provides an inkjet recording apparatus that is equipped with a drying unit whose moving speed is controlled by the output image.

An inkjet recording apparatus pertaining to a first aspect of the invention includes: a conveyance unit that conveys a recording medium; inkjet recording heads that jet ink droplets onto a recording medium surface while scanning in a recording direction that intersects a conveyance direction of the recording medium; a first image converter that converts image data, which have been inputted, into ink data based on the color of ink; a second image converter that converts the ink data into dot data on the basis of which each inkjet recording head jets the ink droplets; a drying unit that is disposed on a conveyance direction downstream side of the inkjet recording heads and dries the ink droplets on the recording medium while moving in a drying direction that differs from the conveyance direction; and a drying unit movement controller that decides a moving speed of the drying unit, the drying unit movement controller controlling the moving speed of the drying unit on the basis of at least one of the inputted image data, the ink data, or the dot data.

According to this aspect, the inkjet recording apparatus can perform scan-drying with respect to scan-printing, can perform efficient drying in accordance with the quantity and the density of the ink droplets that have been jetted, and can prevent over-drying and under-drying.

In an inkjet recording apparatus pertaining to a second aspect of the invention, the drying direction may be the same as the recording direction.

According to this aspect, the inkjet recording apparatus can be given a simple structure because the directions of scan-printing and scan-drying are aligned, and the inkjet recording apparatus can perform simple drying control because the directions of printing and drying are the same.

In an inkjet recording apparatus pertaining to a third aspect of the invention, the inkjet recording apparatus may divide an image formation region of the recording medium surface into plural regions in regard to at least one of the conveyance direction and the recording direction, and on the basis of the inputted image data, the ink data, and the dot data per each region, the drying unit movement controller may decide the moving speed of the drying unit per each of the image formation regions that have been divided.

According to this aspect, the inkjet recording apparatus can reduce cockles of small cycles by performing more efficient drying, preventing over-drying and under-drying, and dividing the places to be dried per region.

In an inkjet recording apparatus pertaining to a fourth aspect of the invention, as for the image formation regions that have been divided, division positions of rows adjacent to each other in the conveyance direction are shifted in the recording direction.

According to this aspect, the inkjet recording apparatus can prevent drying irregularities such as excessive drying and poor drying caused by speed fluctuations when the drying unit accelerates or decelerates.

In an inkjet recording apparatus pertaining to a fifth aspect of the invention, the drying unit may include plural drying sub-units along the conveyance direction, which are configured to operate in variable combinations ranging from the operation of as few as one drying sub-unit to the operation of as many as all drying sub-units.

According to this aspect, the inkjet recording apparatus can reduce drying abnormalities resulting from energy variations (temperature differences, air volume differences, etc.) per drying sub-unit by causing combinations of drying sub-units that differ per single scan to operate.

In an inkjet recording apparatus pertaining to a fifth aspect of the invention, the inkjet recording apparatus may change the drying sub-units that operate per drying movement.

According to this aspect, by changing the drying sub-units that operate per drying movement, the inkjet recording apparatus can reduce drying abnormalities resulting from energy variations (temperature differences, air volume differences, etc.) per drying sub-unit.

In an inkjet recording apparatus pertaining to a seventh aspect of the invention, the conveyance unit may include: a first conveyance unit that conveys the recording medium so as to oppose the inkjet recording heads; and a second conveyance unit that conveys the recording medium so as to oppose the drying unit.

According to this aspect, after a recording medium on which printing has ended in the first conveyance unit has been delivered to the second conveyance unit, the next recording medium can be printed in the first conveyance unit, so the processing capability can be improved. Further, the conveyance units in the printing unit and the drying unit are independent, so even when some of the drying energy resulting from the drying unit is absorbed in the conveyance units and the temperature of the conveyance units ends up rising, that energy does not affect jetting, and poor jetting can be prevented.

An inkjet recording apparatus pertaining to an eighth aspect of the invention includes: a conveyance unit that conveys a recording medium; inkjet recording heads that cover the recording medium across a conveyance width direction and jet ink droplets onto a recording medium surface; a first image converter that converts image data, which have been inputted, into ink data based on the color of ink; a second image converter that converts the ink data into dot data on the basis of which each inkjet recording head jets the ink droplets; a drying unit that is disposed on a conveyance direction downstream side of the inkjet recording heads and dries the ink droplets on the recording medium while moving in a drying direction that differs from the conveyance direction; and a drying unit movement controller that decides the moving speed of the drying unit, the drying unit movement controller controlling a moving speed of the drying unit on the basis of at least one of the inputted image data, the ink data, or the dot data.

According to this aspect, the inkjet recording apparatus can perform scan-drying with respect to paper-width printing, can perform efficient drying in accordance with the quantity and the density of the ink droplets that have been jetted, and can prevent over-drying and insufficient drying.

BRIEF DESCRIPTION OF THE DRAWINGS

An embodiment of the invention will be described in detail with reference to the following figures, wherein:

FIG. 7 is a conceptual diagram showing the relationship between the number of scans pertaining to the embodiment of the invention and drying sub-units that are used.

DETAILED DESCRIPTION OF THE INVENTION

An example of an embodiment pertaining to the present invention will be described below with reference to the drawings. In the description below, an example using a recording medium as a medium-to-be-drawn-upon will be described. In the case of using a medium-to-be-drawn-upon such as a primary transfer belt instead of a recording medium, the present invention can also be applied to a medium-to-be-drawn-upon other than a recording medium by changing "recording medium" to read "medium-to-be-drawn-upon."

Figure 1:
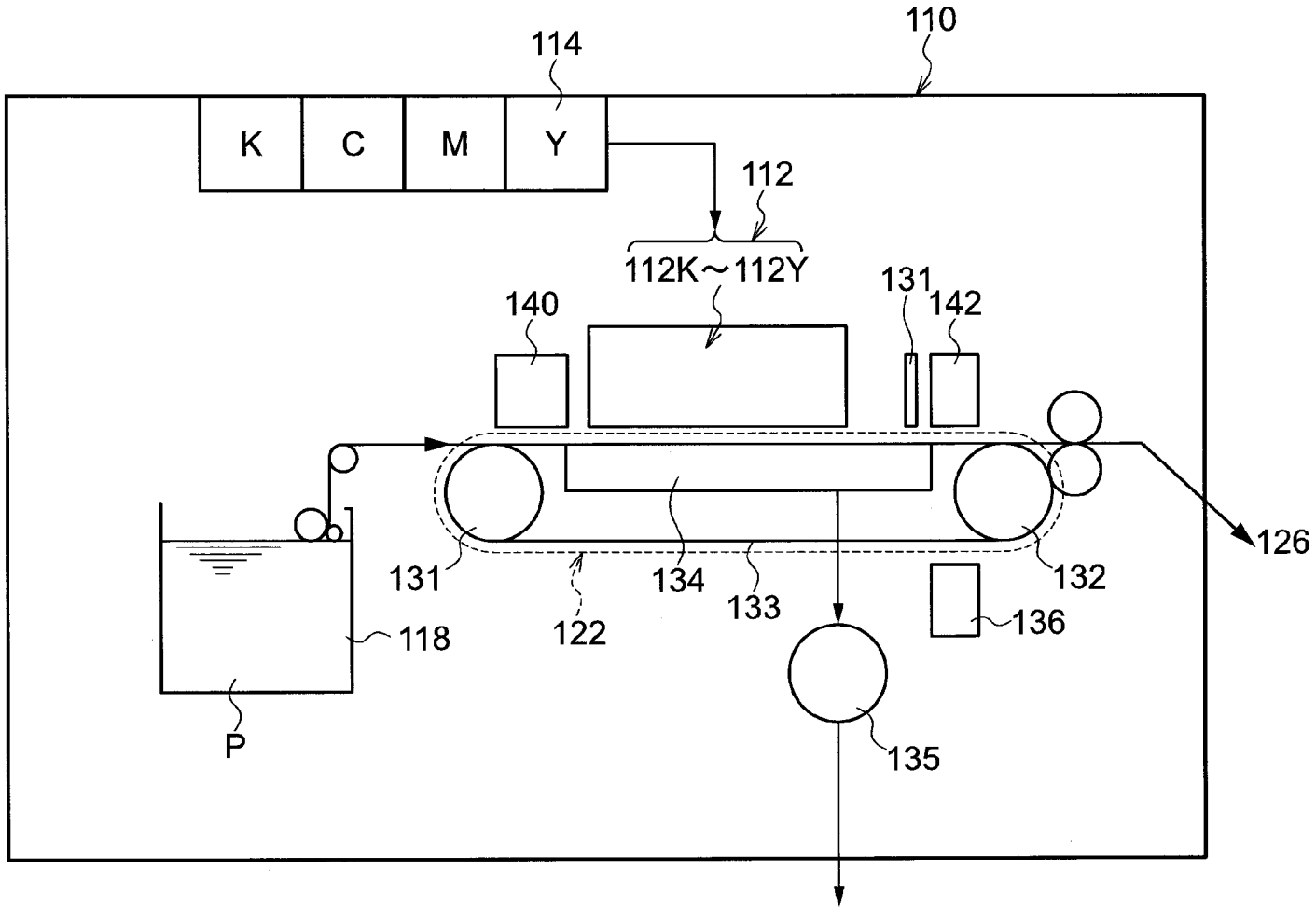
FIG. 1 is a conceptual diagram showing an inkjet recording apparatus pertaining to the embodiment of the invention.

FIG. 1 is a schematic configuration diagram showing the overall configuration of an inkjet recording apparatus pertaining to the embodiment of the present invention.

As shown in FIG. 1, the inkjet recording apparatus 110 is equipped with: a printing unit 112 that has plural recording heads (hereinafter called "heads") 112K, 112C, 112M, and 112Y that are disposed in correspondence to black (K), cyan (C), magenta (M), and yellow (Y) inks; an ink storage unit 114 that stores the inks supplied to the heads 112K, 112C, 112M, and 112Y; a paper supply unit 118 that supplies paper P that is a recording medium; a belt conveyance unit 122 that is placed to oppose a nozzle surface (ink jetting surface) of the printing unit 112 and conveys the paper P while preserving the flatness of the paper P; and a paper discharge unit 126 that discharges recording paper on which recording is finished (printed matter) to the outside. "Printing" as referred to in the present specification also includes the printing of images in addition to the printing of characters.

The ink storage unit 114 has ink tanks that store the inks of the colors corresponding to the heads 112K, 112C, 112M, and 112Y, and the tanks are connected to the heads 112K, 112C, 112M, and 112Y via requisite conduits. Further, the ink storage unit 114 is equipped with reporting means that reports when the remaining quantity of an ink is low, and the ink storage unit 114 has a mechanism for preventing misloading between colors.

In FIG. 1, a magazine of cut paper (sheets) is shown as an example of the paper supply unit 118, but plural magazines whose paper widths, paper qualities, and so forth differ may also be disposed together, and the paper supply unit 118 may use these while switching between them. Further, the paper supply unit 118 may also supply, by means of a cassette into which cut paper has been stacked and loaded, the paper.

Alternatively, the paper supply unit 118 may be equipped with a magazine of roll paper, cut the roll paper into a size to be used, and use the cut paper.

Moreover, in a case where the inkjet recording apparatus 110 is given a configuration capable of utilizing plural types of recording media, an information-recorded body such as a barcode or a radio tag in which media type information is recorded may be attached to the magazine, and the inkjet recording apparatus 110 may automatically discriminate the type (media type) of recording medium to be used by reading, with a reading device, the information of the information-recorded body and perform ink jetting control in such a way as to realize ink jetting that is appropriate depending on the media type.

The paper P that has been separated into each size to be used and loaded into the magazine or which has been cut is sent to the belt conveyance unit 122. The belt conveyance unit 122 is configured in such a way as to have a structure where an endless belt 133 is wrapped across rollers 131 and 132.

The belt 133 has a wider width dimension than the width of the paper P, and numerous suction holes (not shown in the drawings) are formed in the belt surface of the belt 133. In order to fix the paper P on the belt 133, the belt conveyance unit 122 may be given a configuration where, for example, as shown in FIG. 1, a suction chamber 134 is disposed in a position corresponding to the nozzles of the printing unit 112 on the inner side of the belt 133 disposed across the rollers 131 and 132, and the paper P is sucked and held on the belt 133 as a result of a fan 135 sucking the suction chamber 134 to create negative pressure in the suction chamber 135. Alternatively, instead of a suction system, the belt conveyance unit 122 may also employ an electrostatic attraction type or a gripping type resulting from a gripper.

Driving force is transmitted from an unillustrated motor to at least one of the rollers 131 and 132 around which the belt 133 is wrapped, whereby the belt 133 is driven in the clockwise direction in FIG. 1 and the paper P held on the belt 133 is conveyed from left to right in FIG. 1.

When the inkjet recording apparatus 110 prints a borderless print or the like, the inks also adhere onto the belt 133, so a belt cleaning unit 136 is disposed in a predetermined position (an appropriate position outside the printing region) on the outer side of the belt 133. The configuration of the belt cleaning unit 136 is not shown in detail in the drawings, but examples thereof include a nip type that nips a brush roll, a water-absorbing roll or the like, an air blowing type that blows cleaning air, or any combination of these types. In the case of the type that nips a cleaning roll, the cleaning effect is large when the belt linear speed and the roller linear speed are changed.

Instead of the belt conveyance unit 122, an aspect using a roller and nip conveyance mechanism is also conceivable, but in an inkjet recording format like in the present invention, when the printing region is conveyed by means of a roller and a nip, the roller touches the printing surface of the paper immediately after printing, so there is the problem that the image easily bleeds. Consequently, like in the present example, suction belt conveyance that does not touch the image surface in the printing region is preferred.

A heating fan 140 may be disposed on the upstream side of the printing unit 112 on the paper conveyance path formed by the belt conveyance unit 122. The heating fan 140 blows heated air onto the paper P before printing and heats the paper P to thereby heat the paper P immediately before printing, so that it becomes easier for the ink droplets to dry after the ink droplets have landed.

Figure 2A:
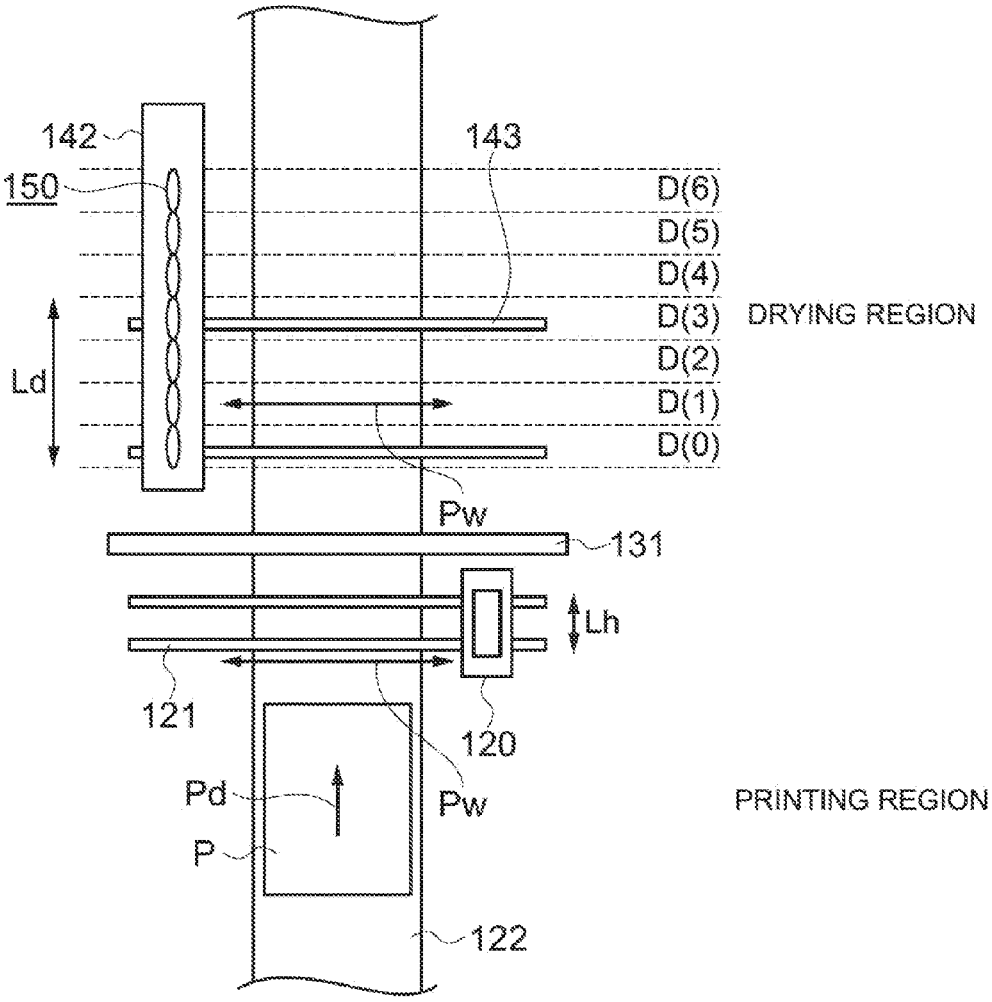
FIG. 2A is a conceptual diagram showing a head unit and a drying unit of the inkjet recording apparatus pertaining to the embodiment of the invention.
Figure 2B:
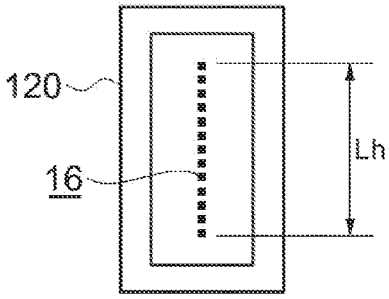
FIG. 2B is a conceptual diagram showing a head unit of the inkjet recording apparatus pertaining to the embodiment of the invention.

The heads (112K, 112C, 112M, and 112Y) in the printing unit 112 are equipped with a head unit 120 per each head. As shown in FIG. 2A and FIG. 2B, each of the head units 120 is disposed in such a way as to be movable in the paper width direction (conveyance width direction Pw) on a rail 121 and, in correspondence to the maximum paper width of the paper P intended for the inkjet recording apparatus 110, is made movable in a length that can cover this maximum paper width.

As shown in FIG. 2B, a row of nozzles 16 is disposed in the surface of each of the head units 120 that opposes the paper P. By jetting liquid droplets (ink droplets) across a length Lh in a paper conveyance direction Pd and moving in the paper width direction Pw, the head units 120 can form Lh×Pw printing regions.

The heads 112K, 112C, 112M, and 112Y are placed in the color order of black (K), cyan (C), magenta (M), and yellow (Y) from the upstream side along the paper conveyance direction Pd, and their head units 120K, 120C, 120M, and 120Y are disposed on the rails 121 in such a way as to be made slidable in the paper width direction Pw.

The inkjet recording apparatus 110 can form a color image on the paper P by jetting the inks of the different colors from the heads 112K, 112C, 112M, and 112Y while conveying, with the belt conveyance unit 122, the paper P.

In this way, by using so-called shuttle heads in which the head units 120 of each color reciprocally operates in the paper width direction Pw, printing is possible with compact heads compared to a line head having a size that covers the conveyance width direction Pw, and apparatus costs can be reduced.

In the present embodiment, a KCMY standard color (four color) configuration is exemplified, but the combination of ink colors and number of colors is not limited to the present embodiment; light inks, dark inks, and special color inks may also be added as needed. For example, a configuration that adds an inkjet head that jets a light ink such as light cyan or light magenta is also possible. Further, there are no particular limitations on the order in which the color heads are arranged.

A drying unit 142 is disposed on the downstream side of the printing unit 112. The drying unit 142 is means that dries the image surface that has been printed. As shown in FIG. 2A, the drying unit 142 is disposed in such a way as to be slidable on a rail 143 and is made reciprocally movable in the paper width direction Pw.

The drying unit 142 is given a configuration where plural sub-units 150 are arrayed in the paper conveyance direction Pd. Hot air fans or infrared (IR) heaters, for example, are suitably used for the sub-units 150. In order to prevent a situation where, because of the heat emitted by the drying unit 142 at this time, the inks inside the nozzles 16 of the head units 120 dry and solidify so that the nozzles 16 end up becoming clogged, it is preferred that the printing region and the drying region shown in FIG. 2A be partitioned by a partition member 131.

The paper P on whose jetting surface an image has been formed through the above-described process is discharged from the paper discharge unit 126. Further, although it is not shown in the drawings, a sorter that accumulates the paper P by order may also be disposed in the paper discharge unit 126.

Moreover, the inkjet recording apparatus 110 may also be given a configuration where the belt conveyance unit 122 is made independent as a belt conveyance unit 122A and a belt conveyance unit 122B separately between the printing unit 112 and the drying unit 142, so that the paper P on which printing has ended in the belt conveyance unit 122A is delivered to the belt conveyance unit 122B and is dried in the drying unit 142. In this case, printing on the next sheet of paper P can be started at the point in time when printing on the preceding sheet of paper P has ended, so the processing capability can be improved.

<Print Modes>

As mentioned above, in each of the head units 120, the row of the nozzles 16 of the length Lh is disposed in the surface that opposes the paper P. The head units 120 jet liquid droplets (ink droplets) across the length Lh in the paper conveyance direction Pd and move in the conveyance width direction Pw, whereby the head units 120 can form Lh×Pw printing regions.

In this way, when "Lh" represents the conveyance direction length of each of the head units 120 (the width that can be printed in one scan), by performing so-called shingling where the paper P is moved only the length of substantially Lh/N each time one scan is performed and where the same region is divided into plural times (N times) and printed, the same region on the paper P can be printed by N number of the nozzles 16 that is variable, and band irregularities caused by position error of the nozzles 16 can be prevented.

Here, the larger N (number of divisions) is made, the less the visibility of band irregularities and the like becomes and the more image quality improves, but this ends up taking more printing time because the number of times of printing increases. Consequently, it is preferable for the inkjet recording apparatus 110 to have several print modes (e.g., a high-speed mode where N=1, a normal mode where N=2, a high image quality mode where N=4, etc.) and to make it possible for the user to select the print modes as needed in consideration of image quality and printing time.

<Drying Unit Control>

Next, a method of controlling the drying unit 142 in the inkjet recording apparatus 110 pertaining to the present embodiment will be described. Although it is not shown in the drawings, in the inkjet recording apparatus 110, there is disposed an unillustrated controller that is equipped with a first image converter that breaks down inputted image data (BGR) into ink data per each color ink of CMYK and a second image converter that converts the ink data into dot data per each of the head units 120 of each color.

Figure 3:
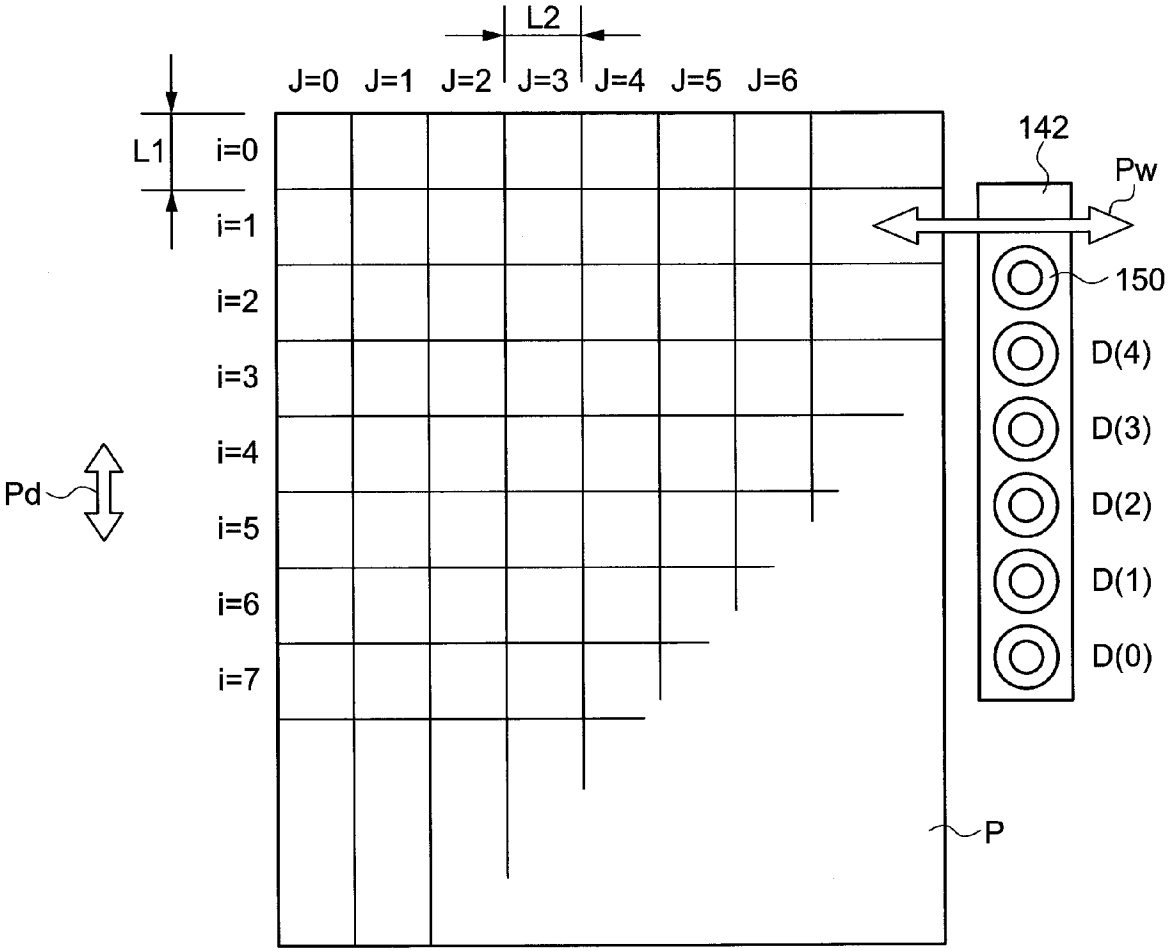
FIG. 3 is an enlarged conceptual diagram showing divided recording regions of the inkjet recording apparatus pertaining to the embodiment of the invention.

Division of Image Region: As shown in FIG. 3, the controller of the inkjet recording apparatus 110 divides the image region into a size of L1 in the conveyance direction and L2 in the scan direction. "i" represents positions in the conveyance direction Pd, so that from the top of the paper P, i=0, 1, 2, and so on to I−1. "j" represents positions in the conveyance width direction (scan direction) Pw, so that j=0, 1, 2, and so on to J−1. Details will be discussed below, but it is preferable to shift the division positions in the scan direction per scan of the drying unit 142.

Assignment of Drying Unit 142: As shown in FIG. 3, the drying unit 142 in the present application comprises M number of the sub-units 150 that are independently operable. Here, hot air fans or IR heaters, for example, are suitably used for the sub-units 150. The sub-units 150 are assigned positions D(0), D(1), and so on to D(M−1) in order from the conveyance direction upstream side. Here, M=2×Nmax−1, and Nmax is the maximum value of the number of times N of shingling mentioned above. A case where Nmax=4 will be taken as an example and described below.

Figure 4:
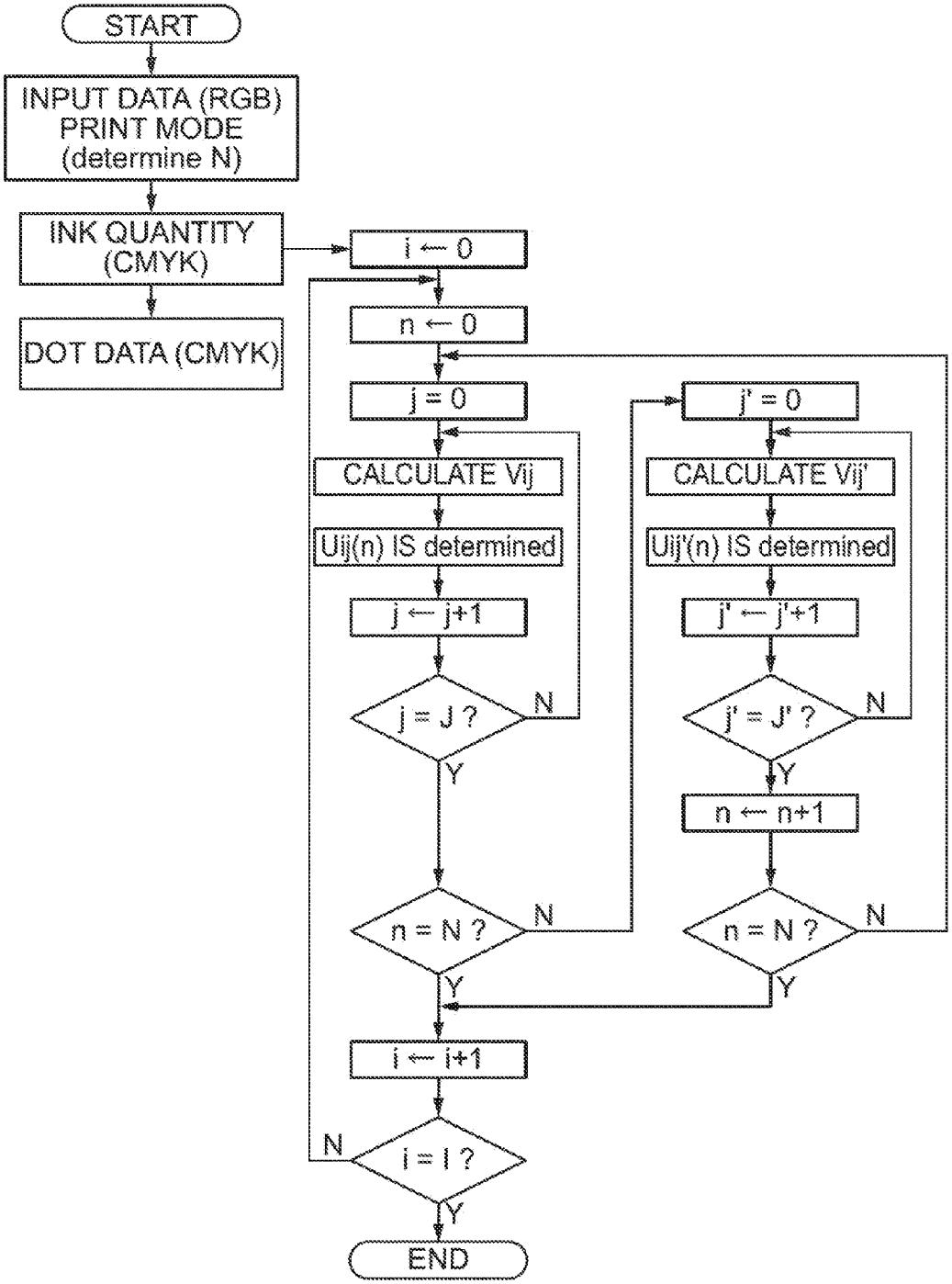
FIG. 4 is a flowchart showing a method of controlling drying in the divided recording regions from image data of the invention.

Actual Flow: As shown in FIG. 4, first, the controller converts an input image (RGB) to be printed into the CMYK ink quantity by image processing. Thereafter, the controller calculates the sum value of the CMYK inks in each region and calculates the ink quantity (CMYK sum value) Vij of each region. A moving speed Uij (n) of the head units 120 in the conveyance width direction Pw when scanning the regions is decided in accordance with that value.

Figure 5:
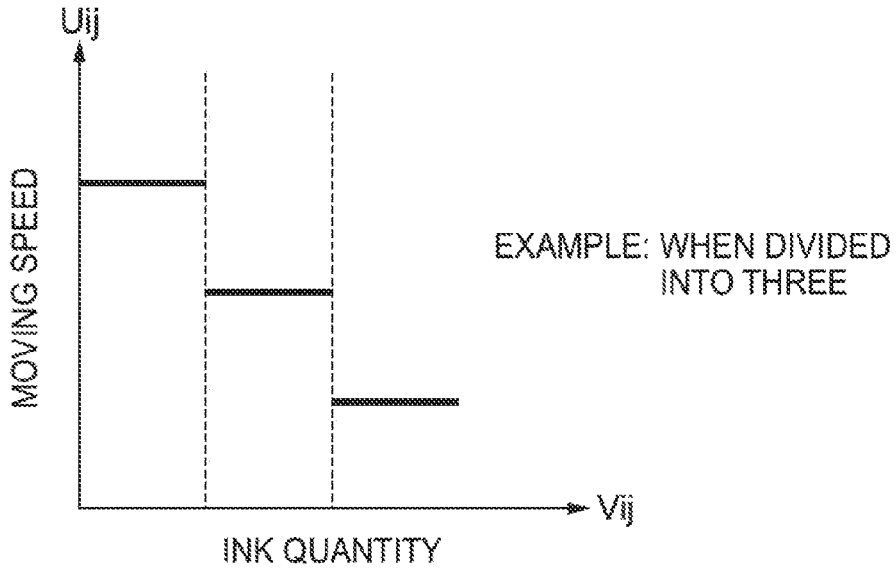
FIG. 5 is a graph showing the relationship between the moving speed of recording heads pertaining to the embodiment of the invention and the quantity of ink that is jetted.

The controller determines the relationship between Vij and Uij like in FIG. 5, for example. The controller calculates this processing in all regions and computes the speed of the drying unit 142 of the $n^{th}$ time in each region. Here, in the flowchart of FIG. 4, the controller finds Uij from the ink quantity (CMYK), but the controller may also find Uij from the input image data (RGB) and N, or the controller may also find Uij from the dot data to be printed.

Here, as shown in the flowchart of FIG. 4, the division positions in the conveyance width direction Pw (scan direction) are shifted as seen from the conveyance direction between when n is even and when n is odd. In the drawing, j indicates when n is even, and j' indicates when n is odd.

Figure 6:
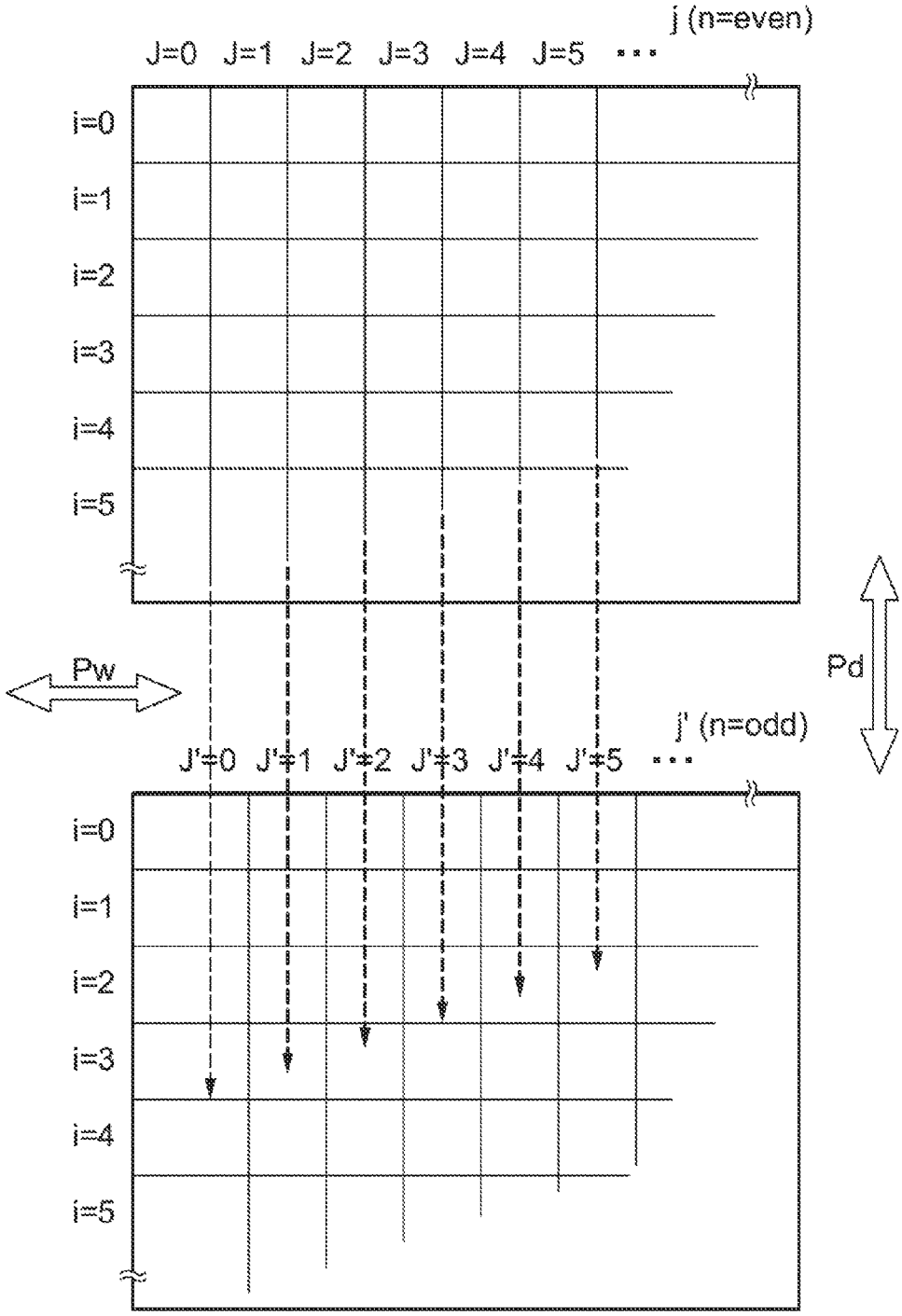
FIG. 6 is a conceptual diagram showing a state where the divided recording regions pertaining to the embodiment of the invention are shifted because of a conveyance direction position.
Figure 8:
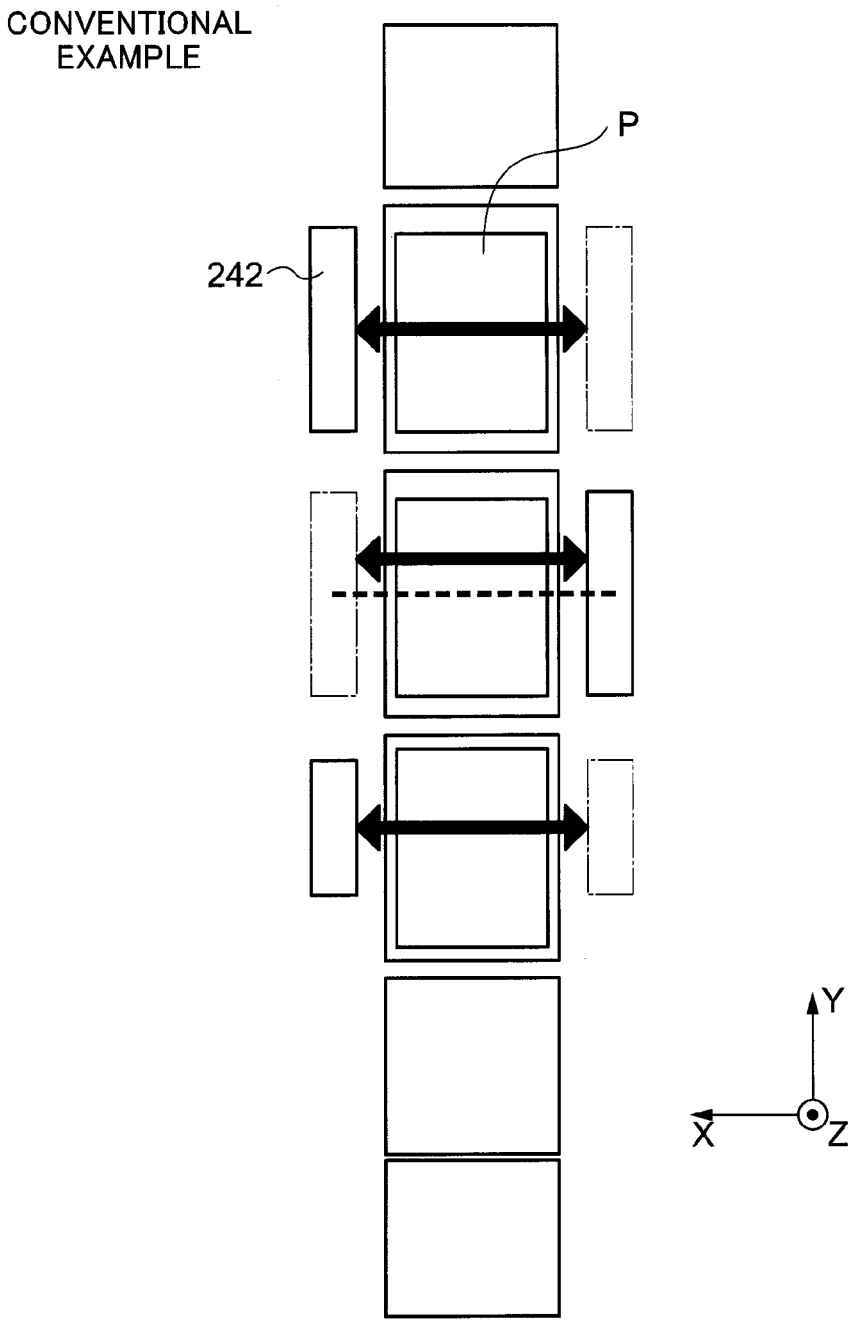
FIG. 8 is a conceptual diagram showing a paper conveyance direction of a conventional image recording apparatus and the movement of a drying unit.

This is for countering the contribution to speed irregularities by the acceleration of the drying unit 142 between division units by shifting the positions of the division positions (divided regions, division units) in the scan direction like in FIG. 6.

That is, in the scan direction Pw, the speed of the drying unit 142 has rises (accelerations) and falls (decelerations), so when the drying unit 142 moves between the division units there is the potential for excessive drying at times the drying unit 142 accelerates and for insufficient drying at times the drying unit 142 decelerates, so in a case where those places had been juxtaposed in the conveyance direction Pd at the same positions on the Pw coordinates, there is fear that drying irregularities will turn into cockles. By shifting the positions of the division units per scan as shown in FIG. 6, drying irregularities can be dispersed, and quality can be maintained.

In accompaniment with the value of Uij(n), the sub-units 150 apply drying energy such as hot air or radiation heat to the surface of the paper P while the drying unit 142 accelerates and decelerates. Here, in one scan by the sub-units 150, drying energy is applied from the Nmax number of continuous sub-units 150, and in the $n^{th}$ scan, the D(s(n)), D(s(n)+1), and so on to D(s(n)+Nmax−1) sub-units 150 are used. Here, s(n)=Nmax/N×n.

As an example, FIG. 7 shows a schematic diagram of the positions (D(n)) of the sub-units 150 actually used when Nmax=4 and N=1, 2, and 4. In this case, the sub-units 150 arrayed in the direction of Pd—that is, the conveyance direction of the paper P—are indicated by D(0) to D(6) in the drawing, and the sub-units 150 that are used are shaded.

As will be understood from FIG. 7, as for the sub-units 150 that are driven (used) every single scan, different sub-units 150 are used in such a way that D(0) to D(3) are used for the first scan, D(1) to D(4) are used for the second scan, and so on. However, in a case where N=1, that is, in a case where there is only a single scan, control such as using D(0) to D(3), for example, like on the right end of the drawing suffices.

As shown in FIG. 7, by using different sub-units 150 each time, even if non-uniformities (irregularities) exist in the quantities of drying energy supplied between the sub-units 150 such as a temperature differences or air volume differences, for example, those non-uniformities can be countered to perform drying with no irregularities.

Even in a case where printing that is performed only where N=1 (single scan) is continuous, the controller may perform control in such a way as to alternate as needed between the sub-units 150 that are used when a new sheet of paper P is conveyed and new printing is performed, to thereby prevent trouble caused by partial overheating or to try to prolong the life of the heaters or the like. That is, the controller may perform control in such a way that, for example, the four sub-units 150 in the positions D(0) to D(3) are used for the first sheet of paper P, the four sub-units 150 in the positions D(1) to D(4) are used for the second sheet of paper P, the four sub-units 150 in the positions D(2) to D(5) are used for the third sheet of paper P, the four sub-units 150 in the positions D(3) to D(6) are used for the fourth sheet of paper P, the four sub-units 150 in the positions D(0) to D(3) are used for the fifth sheet of paper P, and so on.

Similarly, even in a case where printing that is performed only when N=2 (two scans) is continuous, the controller may perform control in such a way as to alternate as needed between the sub-units 150 that are used when a new sheet of paper P is conveyed and new printing is performed, to thereby prevent trouble caused by partial overheating or to try to prolong the life of the heaters or the like. That is, the controller may perform control in such a way that, for example, the four sub-units 150 in the positions D(0) to D(3) are used for the first scan (n=0) of the first sheet of paper P, the four sub-units 150 in the positions D(2) to D(5) are used for the second scan (n=1) of the first sheet of paper P, the four sub-units 150 in the positions D(1) to D(4) are used for the first scan (n=1) of the second sheet of paper P, the four sub-units 150 in the positions D(3) to D(6) are used for the second scan (n=1) of the second sheet of paper P, the four sub-units 150 in the positions D(0) to D(3) are used for the first scan (n=0) of the third sheet of paper P, the four sub-units 150 in the positions D(2) to D(5) are used for the second scan (n=1) of the third sheet of paper P, and so on.

As described above, the present embodiment is given the configuration of an inkjet recording apparatus equipped with a drying unit whose moving speed is controlled by the output image, so the following effects are provided. That is, according to the above-described configuration, the inkjet recording apparatus can perform scan-drying with respect to scan-printing, can perform efficient drying in accordance with the quantity and the density of the ink droplets that have been jetted, and can prevent over-drying and insufficient drying.

Or, even with a configuration that uses an inkjet recording head covering the entire width of the paper P and takes the conveyance direction as the printing direction rather than scan-printing, the inkjet recording apparatus can be given a configuration that performs efficient drying in accordance with the quantity and the density of the ink droplets that have been jetted by performing scan-drying and prevents over-drying and insufficient drying.

<Other>

An embodiment of the present invention has been described above, but the present invention is not in any way limited to the above-described embodiment and, it goes without saying, can be implemented in various aspects in a scope not departing from the gist of the present invention.

For example, in the above-described embodiment, a configuration of an inkjet recording apparatus using ink has been taken as an example, but the present invention is not limited to this; for example, as long as the configuration is equipped with a jetting head that scans over a recording medium and drying means that similarly scans, the configuration may be made into a mechanism to which the embodiment of the present invention is applied.

What is claimed is:

1. An inkjet recording apparatus comprising:

a conveyance unit that conveys a recording medium;

inkjet recording heads that jet ink droplets onto a recording medium surface while scanning in a recording direction that intersects a conveyance direction of the recording medium;

a first image converter that converts image data, which have been inputted, into ink data based on the color of ink;

a second image converter that converts the ink data into dot data on the basis of which each inkjet recording head jets the ink droplets; a drying unit that is disposed on a conveyance direction downstream side of the inkjet recording heads and dries the ink droplets on the recording medium while moving in a drying direction that differs from the conveyance direction; and a drying unit movement controller that decides a moving speed of the drying unit, the drying unit movement controller controlling the moving speed of the drying unit on the basis of at least one of the inputted image data, the ink data, or the dot data, wherein the drying unit movement controller is configured to control the movement of the drying unit independently from the movement of the inkjet recording heads.

2. The inkjet recording apparatus according to claim 1, wherein the drying direction is the same as the recording direction.

3. The inkjet recording apparatus according to claim 1, wherein the inkjet recording apparatus divides an image formation region of the recording medium surface into a plurality of regions in regard to at least one of the conveyance direction or the recording direction, and on the basis of the inputted image data, the ink data, and the dot data per each region, the drying unit movement controller decides the moving speed of the drying unit per each of the image formation regions that have been divided.

4. The inkjet recording apparatus according to claim 3, wherein as for the image formation regions that have been divided, division positions of rows adjacent to each other in the conveyance direction are shifted in the recording direction.

5. The inkjet recording apparatus according to claim 4, wherein the drying unit comprises a plurality of drying sub-units along the conveyance direction, which are configured to operate in variable combinations ranging from the operation of as few as one drying sub-unit to the operation of as many as all drying sub-units.

6. The inkjet recording apparatus according to claim 5, wherein the inkjet recording apparatus changes the drying sub-units that operate per drying movement.

7. The inkjet recording apparatus according to claim 1, wherein the conveyance unit comprises: a first conveyance unit that conveys the recording medium so as to oppose the inkjet recording heads, and a second conveyance unit that conveys the recording medium so as to oppose the drying unit.

8. An inkjet recording apparatus comprising:

a conveyance unit that conveys a recording medium;

inkjet recording heads that cover the recording medium across a conveyance width direction and jet ink droplets onto a recording medium surface;

a first image converter that converts image data, which have been inputted, into ink data based on the color of ink;

a second image converter that converts the ink data into dot data on the basis of which each inkjet recording head jets the ink droplets;

a drying unit that is disposed on a conveyance direction downstream side of the inkjet recording heads and dries the ink droplets on the recording medium while moving in a drying direction that differs from the conveyance direction; and a drying unit movement controller that decides the moving speed of the drying unit, the drying unit movement controller controlling a moving speed of the drying unit on the basis of at least one of the inputted image data, the ink data, or the dot data, wherein the drying unit movement controller is configured to control the movement of the drying unit independently from the movement of the inkjet recording heads.

9. The inkjet recording apparatus according to claim 1, wherein the drying unit comprises M number of the drying sub-units arrayed in the conveyance direction.

10. The inkjet recording apparatus according to claim 8, wherein:

an image region of the recording medium surface is divided into a plurality of image formation regions (i, j), wherein i represents positions in the conveyance direction and j represents positions in the recording direction, the drying unit scans n times for drying the image formation regions (i, j), and the drying unit moves in the recording direction with the moving speed Uij(n), while the drying energy is applied to the image formation regions (i, j), the drying unit movement controller determines the moving speeds Uij(n) of the drying unit at each image formation region (i, j) that has been divided, on the basis of the inputted ink data Vij of each image formation region (i, j), a number of times N represents a division number by which the image formation region is divided in the conveyance direction when the ink droplets are being jetted, Nmax represents a maximum value of the number of times N, M represents 2×Nmax−1, and s(n) represents Nmax/N×n, the sub-units are assigned positions D(0), D(1), and so on to D(M−1) in order from a conveyance direction upstream side, in a $n^{th}$ scan, the drying energy is applied to the image formation regions (i, j) from the Nmax number of the sub-units which are continuous from the sub-unit D(s(n)), and as for the image formation regions that have been divided, division positions between the movement in the $n^{th}$ scan and the movement in a $n+1^{th}$ scan are shifted in the recording direction.

* * * * *